United States Patent [19]

Morris

[11] 4,384,589

[45] May 24, 1983

[54] NOVEL LIQUID DELIVERY SYSTEM FOR TOILETRIES

[75] Inventor: Edward Morris, Paramus, N.J.

[73] Assignee: American Cyanamid Company, Stamford, Conn.

[21] Appl. No.: 286,740

[22] Filed: Jul. 27, 1981

[51] Int. Cl.[3] ..... A45D 40/30

[52] U.S. Cl. ..... 132/88.5

[58] Field of Search ..... 132/88.5, 88.7; 401/196, 202, 198–199, 205–207

[56] References Cited

U.S. PATENT DOCUMENTS

| | | | |
|---|---|---|---|
| 1,863,106 | 6/1932 | Gimonet | 401/196 |
| 2,666,416 | 1/1954 | Rickmeyer | 401/196 |
| 3,179,972 | 4/1965 | Fillmore | 401/202 |
| 3,184,779 | 5/1965 | Lloyd | 401/202 |
| 3,195,544 | 7/1965 | Politzer | 401/198 X |
| 3,623,941 | 11/1971 | Goodenow | 401/196 |

*Primary Examiner*—G. E. McNeill

*Attorney, Agent, or Firm*—Charles J. Fickey

[57] ABSTRACT

Device for applying liquid materials to the skin, said device having a poromeric plastic applicator surface with improved delivery characteristics, and a liquid absorbent cap means fitting over said applicator surface.

11 Claims, 7 Drawing Figures

NOVEL LIQUID DELIVERY SYSTEM FOR TOILETRIES

The present invention relates to a liquid applicator for dispensing toiletries to the skin, and particularly for the application of antiperspirants and deodorants to the human axilla. It more particularly relates to an applicator having a porous delivery surface of improved characteristics.

Liquid applicators in general are well-known in the prior art, particularly the roll-on type commonly for antiperspirants and deodorants. These are disclosed, for example, in U.S. Pat. Nos. 2,749,566; 2,923,957; and 2,998,616. Because of problems with roll-on type applicators, Berghahn et al., U.S. Pat. Nos. 4,050,826 and 4,111,567, devised a liquid applicator comprising a container fitted with a head having a fixed, shaped form made of a non-flexible, non-deformable, sintered porous synthetic plastic resin having a controlled porosity and having omni-directional, interconnecting pores. The liquid overflow problems associated with conventional roll-ons is also present with this type of head and is solved by the provision of a liquid collecting channel adjacent the shaped applicator, permitting the excess liquid to drain back via the channel into an opening through the head into the liquid reservoir. This avoids an accumulation of liquid on the surface of the applicator and resulting crystallization of product being delivered.

In a real sense, the porous plastic applicator of Berghahn et al. resembles the conventional roll-on applicator except that it is stationary and has a drain channel. The liquid product being delivered must be brought into contact with the applicator head in order for the liquid to be delivered to the surface by capillary action. This requires inverting the container, as is true of the roll-on type of head, since there will always be dead space between the liquid in the reservoir and the applicator head. Thus, no way is provided for the liquid in the reservoir always to be in contact with the applicator head.

In commonly assigned, copending application Ser. No. 183,515, filed Sept. 2, 1980, is disclosed a delivery system for liquid toiletry products whereby a liquid product is absorbed into an absorbent material which is in intimate contact with a non-flexible, non-deformable, sintered, porous synthetic plastic resin applicator head having a controlled porosity and omni-directional interconnecting pores, and whereby the absorbed liquid product is continuously delivered to the porous applicator head by capillary flow on demand.

The device of the copending application has the advantage of eliminating dead air space and the need to invert the container, since the liquid is always in contact with the applicator head and available on demand at the surface of the applicator head.

The applicator head of the copending application was of any suitable configuration, and a convex outer surface has been found to be particularly suitable for contact with various parts of the human body. Thus the applicator head could have a hemispherical shape, either solid or hollow.

The present invention relates to an improved porous applicator head having better liquid flow control. The applicator head of the present invention has a hollow, convex curved configuration, for example a hollow hemispherical dome shape with a part of the inner surface sealed to prevent passage of liquid. The open area is at the apex of the inner surface, and liquid flows only through this area, which is the point which would normally contact the skin. Thus the amount of liquid passing through the porous head is restricted. The liquid that does reach the outer surface of the porous applicator head is spread on the skin, and any excess is absorbed as it flows down the surface of the head. A cap is provided for the package which has an absorbent inner layer to aid in preventing dripping of liquid from the top of the applicator head.

The materials which are used to make the shaped applicator head are non-flexible, non-deformable, sintered, porous synthetic resins having a controlled porosity and having omni-directional interconnecting pores, formed of aggregates of united polymer particles. The degree of porosity of the porous materials can be controlled in their manufacture, thus insuring a wide range of porosity to suit a wide range of liquid products of varying viscosities. Sintered, porous applicator heads may be fabricated of high-density polyethylene, low-density polyethylene, ultra-high molecular weight polyethylene, polypropylene, polyvinylidene fluoride, and the like. Products are available commercially under the trade designations "Porex" porous plastics and "Porous Poly." The pore size of the applicator may vary widely, depending on the liquid to be delivered. Low-viscosity liquids, such as perfumes, may best be delivered via a small-pore plastic applicator, e.g., one micron or less. In general, the pore size may vary between about one to 200 microns, and for most purposes, generally about 10–50 microns are preferred.

The present invention may also incorporate an absorbent material in the reservoir, onto which the liquid to be delivered is adsorbed, and this absorbent material is in direct and intimate contact with the porous applicator head. This aspect of the invention causes continuous contact of the liquid with the applicator head and ease of delivery of the liquid on demand by capillary flow. The absorbent material used in the reservoir may be any material capable of absorbing the liquid to be delivered, such as cellulose acetate, polyester, cotton, rayon, nylon, or other suitable material, and capable of transferring the liquid therefrom continuously on demand by capillary flow (wicking). The absorbent material may take any suitable shape or form. In one embodiment, the absorbent material is the same non-deformable, non-flexible, sintered, porous synthetic resin material from which the applicator head is constructed. The form may vary, but a particularly advantageous delivery system will consist essentially of a container to hold the contents to be delivered, fitted with a cylindrical piece of porous plastic, extending to the bottom of the container, and having a hemispherical top. The diameter of the cylindrical piece need not be uniform, i.e., the portion extending into the container may be of a lesser diameter than the portion extending out of the container. This may be thought of as a non-flexible, non-deformable wick.

The container may obviously be of any suitable shape and design and may be constructed of any suitable material, such as metal, glass, or plastic and may be rigid or flexible.

The delivery system of the invention may be used to deliver any topical liquid product to the skin. These may include, for example, after-shave lotions, pre-shave lotions, skin lubricants or emollients, suntan lotions, fragrances (perfumes, colognes, etc.), topical therapeutics (analgesics, acne formulations, antiseptics, etc.), and the like. The delivery system is particularly useful in applying antiperspirants and deodorants and avoids the problems associated with roll-on applicators. Thus, the invention provides a means of applying a low viscosity, fast drying, non-sticky solution of aluminum chlorhydrate, avoiding the undesirable features of roll-ons, pump sprays, and sticks.

Since the porous plastic materials are hydrophobic and do not "wet" with water, it may be necessary to add alcohol to an antiperspirant formula to transfer the product from the container to the applicator head. Crystallization of the solid components of the solution, such as aluminum chlorhydrate, may be avoided by the addition of certain esters, such as isopropyl myristate or isopropyl palmitate.

The invention may be better understood by reference to the drawings in which.

Figure 1:
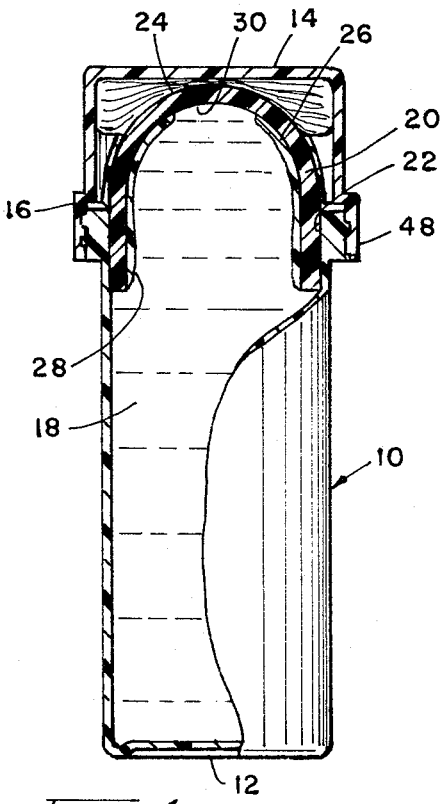
FIG. 1 is an elevational view of the liquid delivery system of the invention with parts broken away to show a cross-section of the case, applicator head and cap.
Figure 6:
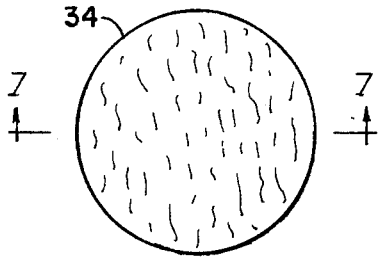
FIGS. 6 and 7 are plan and cross-sectional side views respectively of the absorbent member of the cap.
Figure 7:
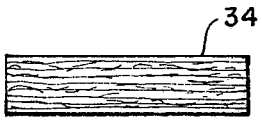
Figure 2:
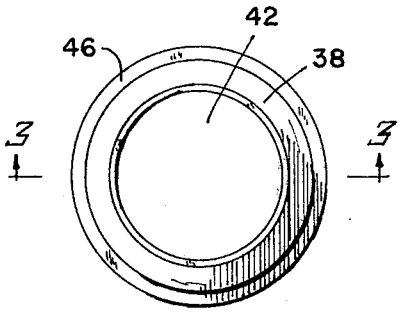
FIG. 2 is a top plan view of the inner seal of the cap.
Figure 5:
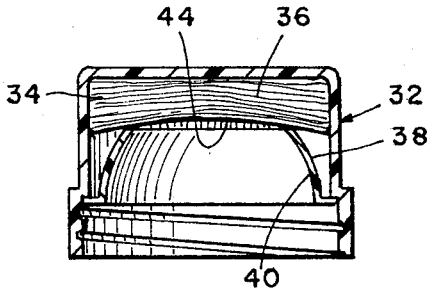
FIG. 5 is a cross-sectional view of the resilient member, taken along the lines 5—5 of FIG. 4.
Figure 3:
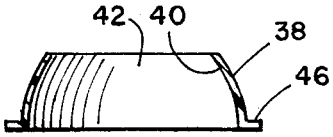
FIG. 3 is a cross-sectional view of the inner seal taken along the lines 5—5 of FIG. 2.
Figure 4:
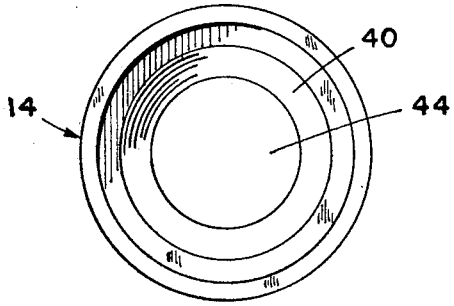
FIG. 4 is a bottom plan view of the inner resilient member of the cap.

Referring to the FIGS., the liquid delivery system comprises an outer case 10 having a base 12 and a cap 14 which is attached by means of threads 16 at the top of case 10. It will be understood that cap 14 could be attached by a friction fit also. Case 10 contains the liquid product 18 to be dispensed. The liquid product may be absorbed in an absorbent material, not shown, if desired. A porous plastic applicator head 20 is fitted into the open end 22 of case 10. In the embodiment shown the applicator head 20 has a hemispherical outer surface 24 and is hollow inside. As shown in FIGS. 2 and 3 the applicator head 20 is coated on its inner surface 26, with a non porous absorbent material 28 except for the area 30 of inner surface 26. The coating material 28 serves to close the pores on inner surface 26 where it is coated, so that liquid 18 only flows out through porous head 20 through the area 30. Coating material 28 can be any suitable inert chemical material such as epoxy resin, or the like. It will be recognized that the pores of inner surface 26 could be sealed by other means, such as by heat fusion of the inner surface during or after manufacture of the porous head, or by the use of an impervious sleeve that conforms to the shape of the inner surface of applicator head 20.

The cap 14 may be of any suitable configuration and may be a friction fit, although it has been shown as a threaded fit.

A particularly advantageous cap structure is described in copending commonly assigned application Ser. No. 267,989, filed May 28, 1981, and is shown in FIGS. 4 through 9. Cap 14 comprises a cylindrical body 32, which may be plastic, glass, metal or the like. An absorbent layer 34 is fitted into the top area 36 of cap 14. Absorbent layer 34 is secured in place by a holding ring 38, which is fitted immediately above threads 16 of cap 14 and may be friction fitted or adhesively secured. Holding ring 38 is made of a suitable plastic, and has a generally hemispherical inner surface 40, conforming to the outer surface 24 of dispenser head 20 with the apex cut out to leave opening 42, exposing an area 44, of absorbent layer 34, and allowing area 44 to contact dispenser head 20 when cap 14 is affixed to case 12. Ring 38 has a flange 46 at its lower periphery which seats against the upper edge 48 of case 12. When cap 14 is threaded onto case 12, the inner surface 40 of holding ring 38 fits tightly against the outer surface 24 of porous applicator head 20, and flange 46 fits tightly against upper edge 48 of case 10, thus preventing leakage of liquid from under cap 14. Any excess liquid on the surface 24 of applicator head 20 will be absorbed by absorbent layer 34 in area 44 exposed by the opening 42 in holding ring 38, since layer 34 is of sufficient thickness to fit closely over the apex of applicator head surface 24. In addition, any vapors or liquids which pass through porous head 24 due to a rise in temperature above ambient and consequent expansion of the contents in case 10, or when the case is tipped from the vertical position, will be absorbed by layer 34.

In an alternative embodiment, holding ring 38 may be replaced by a simple retaining ring (not shown) to hold absorbent layer 34 in cap 14.

Thus cap 14 prevents leakage of liquid under all conditions which can occur.

A variety of liquid products may be dispensed by means of the invention. Illustrative products are set forth in the following specific Examples.

AFTER SHAVE LOTIONS

Example 1—After Shave Lotion

| | %/Weight |
|---|---|
| Alcohol (SDA-40 or 39C) | 60.00 |
| Propylene Glycol | 3.00 |
| Water, deionized | 36.00 |
| Fragrance | 1.00 |

EXAMPLE 2—after shave lotion (high emollience)

| | %/wt. |
|---|---|
| Alcohol (SDA-40) | 75.00 |
| Di-isopropyl Adipate | 10.00 |
| Propylene Glycol | 5.00 |
| Water, deionized | 9.25 |
| Fragrance | 0.75 |

EXAMPLE 3—after shave lotion (low alcohol, antiseptic)

| | %/wt. |
|---|---|
| Alcohol (SDA-40) | 40.000 |
| Hyamine 10× (Rohm & Haas) methyl benzethonium chloride | 0.250 |
| Menthol | 0.005 |
| Ethyl p-aminobenzoate | 0.025 |
| Water, deionized | 59.720 |
| Fragrance | q.s. |

PRE-SHAVE LOTIONS

EXAMPLE 4—Pre-shave (beard softener and lubricant)

| | %/wt. |
|---|---|
| Alcohol (SDA-40) | 80.00 |
| Di-isopropyl Adipate | 5.00 |
| Menthol | 0.05 |
| Propylene Glycol | 3.70 |
| Lactic Acid (80%) | 0.30 |
| Water, deionized | 9.95 |
| Perfume | 1.00 |

EXAMPLE 5—Pre-shave Lotion

| | %/wt. |
|---|---|
| Standamul G (Henkel) (octyl dodecanol) | 10.00 |
| Alcohol (SDA-40) | 90.00 |
| Perfume, Color, Preservatives | q.s. |

EXAMPLE 6—Pre-electric Shave

| | %/wt. |
|---|---|
| Di-isopropyl Adipate | 15.00 |
| Alcohol (SDA-40 or 39C) | 84.00 |
| Perfume | 1.00 |

EXAMPLE 7—Pre-electric Shave

| | %/wt. |
|---|---|
| Isopropyl Myristate | 19.00 |
| Alcohol (SDA-40) | 71.00 |
| Water, deionized | 10.00 |
| Perfume | q.s. |

EXAMPLE 8—Pre-electric Shave (astringent type)

| | %/wt. |
|---|---|
| Zinc Phenolsulfonate | 1.00 |
| Alcohol (SDA-40) | 40.00 |
| Menthol | 0.10 |
| Camphor | 0.10 |
| Distilled Witch Hazel Extract | 40.00 |
| Water, deionized | 18.80 |

SKIN LUBRICANTS/EMOLLIENTS

EXAMPLE 9

| | %/wt. |
|---|---|
| Mineral Oil, 50 cs. visc. | 99.5 |
| Perfume | 0.5 |
| Color, Preservatives | q.s. |

EXAMPLE 10

| | %/wt. |
|---|---|
| Lantrol AWS (Emery) | 10.00 |
| Water, deionized | 35.00 |

-continued

| | %/wt. |
|---|---|
| Alcohol SDA-40 (95%) | 55.00 |
| Perfume | q.s. |

SUNTAN LOTIONS

EXAMPLE 11—Suntan Oil

| | %/wt. |
|---|---|
| Isopropyl Isostearate | 45.00 |
| Lanolin Oil | 2.00 |
| Amyl Dimethyl PABA | 1.00 |
| Mineral Oil, 355 cs. | 51.90 |
| Propylparaben | 0.10 |

EXAMPLE 12—Clear Hydroalcoholic Suntan Lotion

| | %/wt. |
|---|---|
| Acetylated Lanolin Alcohol | 2.5 |
| Alcohol, SDA-40 (95%) | 60.0 |

EXAMPLE 13—Clear Hydroalcoholic Suntan Lotion (cont'd.)

| | %/wt. |
|---|---|
| Amyl Dimethyl PABA | 2.5 |
| Water, deionized | 17.5 |
| Glycerin | 10.0 |
| Oleyl Alcohol | 7.5 |

EXAMPLE 14—Suntan Liquid

| | %/wt. |
|---|---|
| Ucon Fluid LB-625 (Union Carbide) | 60.775 |
| PPG-24 Butyl ether | |
| Alcohol, SDA-40 (95%) | 30.000 |
| Homomenthyl Salicylate | 8.000 |
| Perfume | 1.200 |
| Color (1% FD&C Yellow #6) | 0.025 |

EXAMPLE 15

| | %/wt. |
|---|---|
| Propylene Glycol para Amino Benzoate | 4.0 |
| Tween 20 (polyoxyethylene sorbitan monolaurate) | 9.0 |
| Alcohol SDA-40 (95%) | 45.0 |
| Water | 42.0 |

FRAGRANCE

EXAMPLE 16—Cologne (Men's or Ladies)

| | %/wt. |
|---|---|
| Alcohol SDA-40 | 80–90 |
| Perfume | 4–6 |
| Water, deionized | 4–16 |

EXAMPLE 17—Emollient Cologne

| | %/wt. |
|---|---|
| Alcohol SDA-40 | 70.5 |
| Water, deionized | 19.5 |
| Dipropylene Glycol | 5.0 |
| Lantrol AWS (Emery) (PEG-75-Lanolin Oil) | 5.0 |
| Perfume | q.s. |

TOPICAL THERAPEUTICS

EXAMPLE 18—Analgesic (for relief of muscular pain)

| | %/wt. |
|---|---|
| Methyl Salicylate | 10.00 |
| Oleoresin Capsicum | 1.00 |
| Methyl Nicotinate | 0.25 |
| Isopropyl Myristate | 5.00 |
| Alcohol SDA-40 | 83.75 |

EXAMPLE 19—Acne Treatment

| | %/wt. |
|---|---|
| Salicylic Acid | 3.00 |
| Boric Acid | 2.00 |
| Methyl Benzethonium Chloride | 0.08 |
| Isopropyl Alcohol | 63.00 |
| Water, deionized | 31.92 |

ANTIPERSPIRANT COMPOSITION

EXAMPLE 20

| | %/Weight |
|---|---|
| Aluminum Chlorhydrate (50% aq.) | 50.0 |
| Ceraphyl 41 (Van Dyk) ($C_{12}$-$C_{15}$ Alcohol-lactate ester) | 5.0 |
| SD-40 Ethanol (190) | 45.0 |

I claim:

1. A liquid applicator suitable for use in the application of liquids to a surface of the human body comprising a container having a container body adapted for storing a quantity of said liquid, said container having an opening at the upper end thereof, hollow dome shaped applicator means positioned in said opening, said applicator means being releasably secured in said opening; said applicator means comprising a non-flexible, non-deformable, sintered, porous synthetic resin structure having a controlled porosity and having omnidirectional interconnecting pores, the interior surface of said applicator means being impervious to the liquid except for the area at the apex thereof.

2. The liquid applicator of claim 1 wherein said interior surface is made impervious by application of a layer of material impervious to said liquid to said interior surface.

3. The liquid applicator of claim 1 wherein said interior surface is made impervious by heat fusion of said surface.

4. The liquid applicator of claim 1 wherein said interior surface is made impervious by application of pressure to said surface.

5. The liquid applicator of claim 1 comprising in addition an absorbent wicking means within said container body capable of absorbing said liquid stored therein, said wicking means being positioned in intimate contact with said shaped applicator means, whereby said liquid is transferred to said applicator means by capillary flow through said wicking means.

6. The liquid applicator of claim 1 wherein said wicking means comprises a natural or synthetic fibrous material.

7. The liquid applicator of claim 1 comprising in addition a cap fitted over said applicator means.

8. A porous applicator head for use in a container for liquids to be applied to the human body, said applicator head comprising a porous hollow dome shaped structure of non-flexible, non-deformable, sintered, synthetic resin having a controlled porosity and having omnidirectional interconnecting pores, the interior surface of said applicator head being impervious to liquids except for the area at the apex thereof.

9. The porous applicator head of claim 8 wherein said interior surface is made impervious by application of a layer of material impervious to said liquid to said interior surface.

10. The porous applicator head of claim 8 wherein said interior surface is made impervious by heat fusion of said surface.

11. The porous applicator head of claim 8 wherein said interior surface is made impervious by application of pressure to said surface.

* * * * *